United States Patent [19]

Lund

[11] 4,363,274

[45] Dec. 14, 1982

[54] CENTER LINE FOLLOWER

[75] Inventor: Raymond R. Lund, West Columbia, S.C.

[73] Assignee: Canron Corporation, West Columbia, S.C.

[21] Appl. No.: 227,975

[22] Filed: Jan. 23, 1981

Related U.S. Application Data

[63] Continuation of Ser. No. 951,131, Oct. 13, 1978, abandoned.

[51] Int. Cl.[3] ..... E01B 29/00

[52] U.S. Cl. ..... 104/2; 33/149 J; 104/7 B; 104/8; 180/131

[58] Field of Search ..... 104/1 R, 2, 7 B, 8, 104/16, 17 R, 17 A, 244.1; 180/79, 131; 227/5, 6; 172/23; 171/55; 56/10.2; 33/148 H, 149 J

[56] References Cited

U.S. PATENT DOCUMENTS

| | | | |
|---|---|---|---|
| 2,929,457 | 3/1960 | Langerak | 172/23 |
| 3,314,373 | 4/1967 | Plasser et al. | 104/8 |
| 3,430,723 | 3/1969 | Brooks | 180/79 |
| 3,492,949 | 2/1970 | Brown | 104/244.1 |
| 3,706,284 | 12/1972 | Plasser et al. | 104/7 B |
| 3,724,584 | 4/1973 | Varichon | 180/79 |
| 4,165,694 | 8/1979 | Theurer | 104/7 B |
| 4,170,942 | 10/1979 | Theurer | 104/7 B |

FOREIGN PATENT DOCUMENTS

| | | | |
|---|---|---|---|
| 281561 | 2/1914 | Fed. Rep. of Germany | 104/8 |
| 854827 | 11/1960 | United Kingdom | 180/131 |
| 494138 | 2/1976 | U.S.S.R. | 180/131 |
| 546313 | 3/1977 | U.S.S.R. | 180/131 |
| 527150 | 7/1977 | U.S.S.R. | 180/131 |

*Primary Examiner*—Randolph A. Reese

*Attorney, Agent, or Firm*—Wenderoth, Lind & Ponack

[57] ABSTRACT

An electromechanical device for sensing the center line of a track is disclosed. The track center line is previously marked out by a line of nails protruding upwardly from the ties and the center line follower is moved by engagement with the rails to right or left to derive an appropriate electrical signal causing operation of a ram carrying the center line follower in a direction to cancel the signal. A track operating device, such as a magnetic wheel for picking up tie plates from track that is being renewed, is disposed over each rail location and the top track operating devices are moved laterally conjointly with the center line follower thus to maintain the track operating devices at the correct lateral locations.

12 Claims, 6 Drawing Figures

CENTER LINE FOLLOWER

This application is a continuation application of Ser. No. 951.131, filed Oct. 13, 1978 now abandoned.

BACKGROUND OF THE INVENTION

This invention relates to a device for following the centre line of a railway track.

In application Ser. No. 899,969 of Raymond Ralph Lund filed on Apr. 25, 1978 there is described a machine for removing existing rails and laying new rails on the old ties. Various operations have to be carried out after the lifting of the old rails before the new rails are laid down. For example, it is necessary to pick up the old tie-plates, sweep or crib the ballast clear of the old ties at the tie plate locations, adze the ties at these locations and drop at these locations tie-plates, either recycled or different ones, to receive the new rails. As described in the above patent application these operations are carried out automatically by tie-plate pick up means, crib sweeping means, adzer and tie-plate dropper means, respectively, mounted on the machine. It should be appreciated that all of the above operating means are provided for each rail and that e.g. the two tie-plate pick up means are mounted the rail gauge distance apart. The same is true for the other pairs of operating means.

As indicated in the prior application, the various pairs of operating means may be mounted for transverse movement on their frames under the control of a centre line follower such as a photocell which detects or follows a centre line previously painted on the track. This permits the pairs of operating means to be correctly positioned laterally at the rail locations even when the machine is negotiating a curve on the track.

While the photocell centre line follower described would work satisfactorily, it is difficult to ensure a "true painted line of predetermined width particularly where the paint is being applied to the ballast between the ties and, if the line varies in width the centre line follower would tend to oscillate even on straight track."

SUMMARY OF THE INVENTION

It is an object of the present invention to provide an improved apparatus and method for following the centre line of a railway track.

According to a broad aspect of the invention, there is provided a method of laterally positioning a railway track operating device, which is mounted for lateral movement on a rail-mounted machine, with respect to the centre line of the track comprising marking the centre line of the track by means of nails driven into at least some of the ties, and passing a centre line follower device mounted on the track operating device along the track, the centre line follower being adapted to engage the nails and derive an electrical signal representative of the lateral direction in which the follower deviates from the centre line and using this electrical signal to drive the centre line follower and track operating device in a lateral direction so as to cancel the electrical signal.

According to another broad aspect of the invention, there is provided a rail-mounted machine provided with a main frame and a secondary frame mounted for lateral movement on the main frame, the secondary frame carrying two similar track operating means for carrying out a specific operation at two respective lateral locations relative to the centre line of the track, and means for moving the secondary frame laterally relative to the main frame under control of a centre line follower to position the track operating means at the respective lateral locations, wherein the centre line follower comprises a housing having an open bottom, two spaced sliders contained in the housing and extending generally longitudinally relative to the main frame, means mounting each slider on the housing for relative movement in a direction towards and away from the other slider, means biasing the sliders to a relatively proximate position in which the sliders define a longitudinal channel of predetermined width and location and, means deriving electrical signals which indicate which slider has been moved laterally away from the proximate position.

Figure 3:
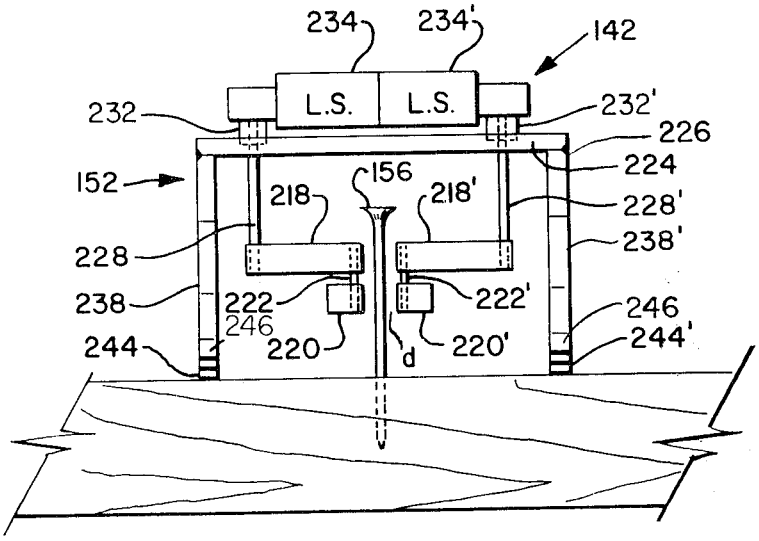
Figure 4:
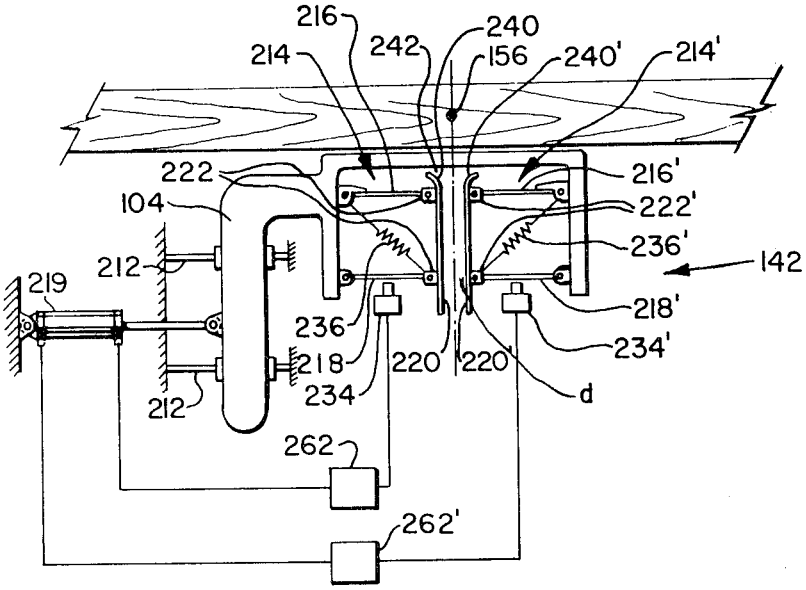

FIG. *2a* is a fragmentary perspective view of the periphery of a magnetic wheel forming part of the tie plate lifting device;

FIG. 3 is a front view of the detector mechanism of a centre line follower according to the present invention;

FIG. 4 is a somewhat schematic plan view of the detector mechanism of FIG. 3 with the outer housing removed for clarity and showing schematically how the detector mechanism reacts with the other components of the centre line follower.

DESCRIPTION OF THE PREFERRED EMBODIMENT

Figure 1A:
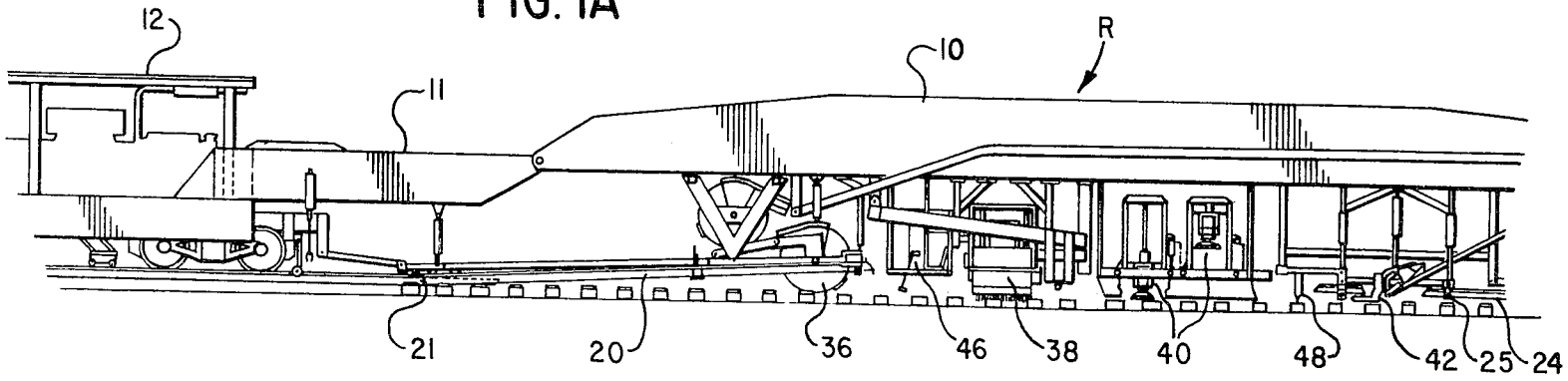
FIGS. 1A and 1B together constitute a schematic view of a rail changing machine incorporating novel tie plate pick up means, adzers and tie plate drop means.
Figure 1B:
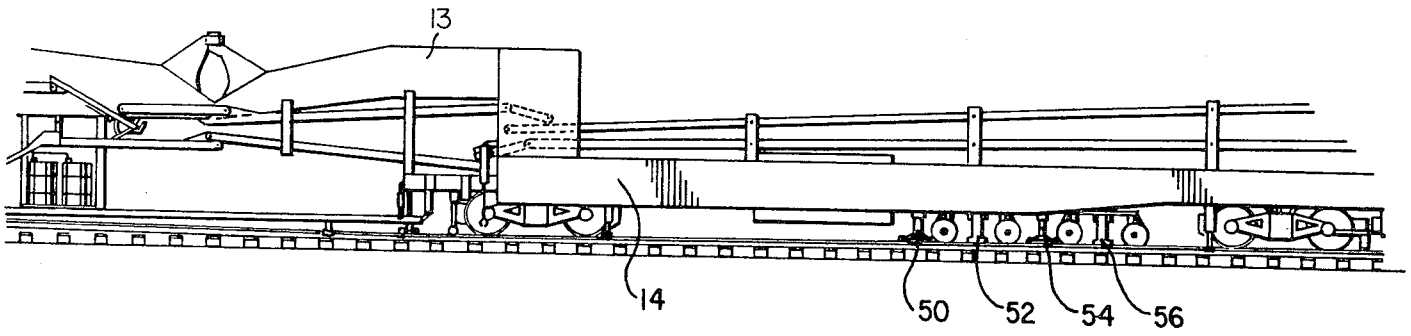

Referring to FIGS. 1A and 1B, the center beam or main frame 10 of a rail changing machine R is shown connected to the beam 11 of a leading powered car 12 and to the beam 13 of a trailing car 14. The old rails 20 of the old track are shown being picked up by rollers 21 of the old conventional rail removing means and these rails are then spread by spreaders (not shown) and deposited on the shoulders of the track in a known manner. New rails 24 have previously been deposited on the shoulders of the track adjacent the existing rails 20 and new rail rollers 25 of a new rail laying means controlled by an operator pick up and lay the new rail, as is known.

Between the old rail moving means and the new rail moving means are positioned a series of track working instruments each mounted on a respective work frame. These instruments comprise, in turn, a magnetic pick-up means 36 for the tie plates left after lifting and spreading of the old rails, crib sweeping means 38 mounted in front of an adzer 40 and tie plate dropping means 42.

A hole plugging station 46 is provided between the tie plate pick-up 36 and the crib sweeper 38 and a creosoting station 48 is preferably provided after the adzer.

A lining device 50, line spiker 52, gauger 54 and gauge spiker 56 complete the work stations.

In operation, the tie plate pick-up means 36 picks up the old tie plates left after lifting and spreading of the old rails, it being understood that the spikes securing the old rails to the ties would have been removed as a preliminary step, as is known. As the machine advances, a human operator in the hole plugging station injects a polyurethane foam into the old spike holes. The cribber 38 then sweeps a path in front of the adzer 40 to remove ballast and other debris from the line of the adzer which proceeds to adze the ties at the tie plate locations at each rail to provide flat beds of increased size in the upper surface of the tie which are capable of receiving new or recycled tie plates of increased size.

The creosoter 48 then supplies creosote to the adzed surfaces of the tie and the new or recycled tie plates are dropped onto the prepared ties by tie plate dropper 42 after which lining of the track, line spiking, gauging and gauge spiking are carried out.

Each of the various track working instruments does, of course, have means for operating simultaneously at the right and left rail locations. For example, the adzer comprises two adzer devices (see FIG. 2) both mounted on a single frame and the crib sweeper comprises two spaced brushes mounted on the frame.

The pairs of devices at each work station are mounted on the respective frame at a distance apart corresponding to the track gauge and the frames are laterally movable conjointly in response to signals from a center line follower, which detects the track center line, so as to maintain the devices situated over the appropriate rail locations even on curved sections of track.

Figure 2:
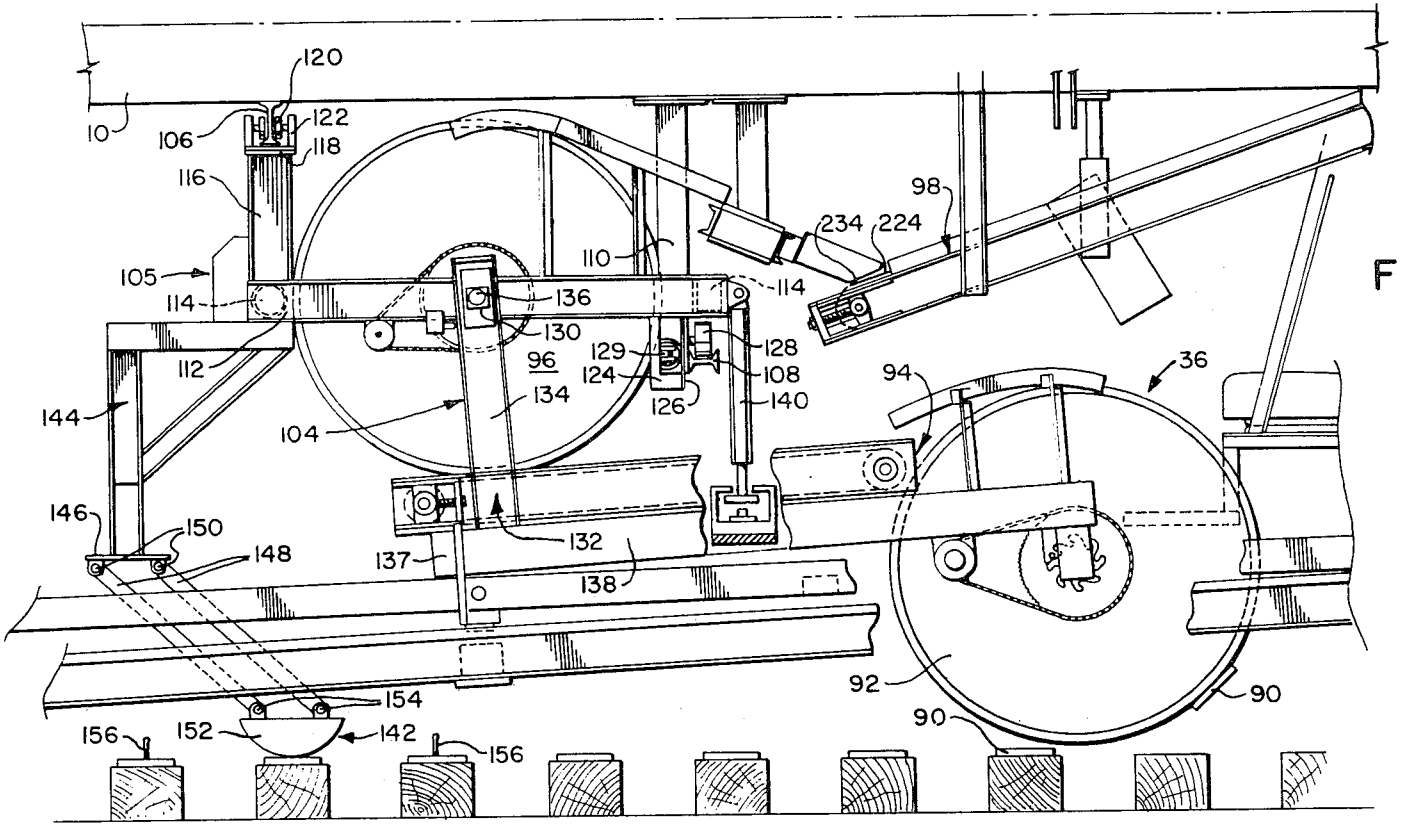
FIG. 2 is a side view of a tie plate lifting device incorporated in the machine of FIG. 1.
Figure 2A:
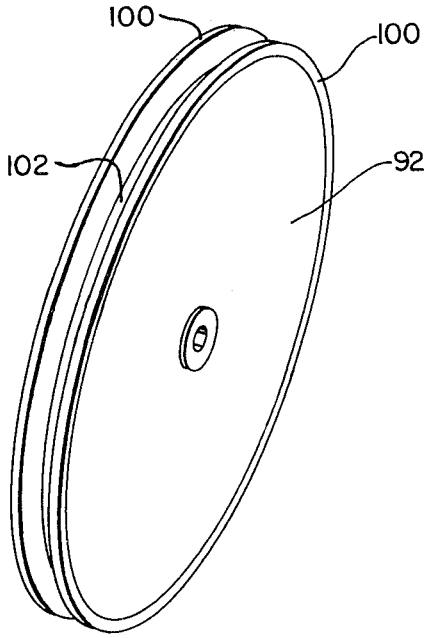

Referring now to FIG. 2, the device 36 for picking up old tie plates 90 from the ties comprises a first magnetic wheel 92 arranged to engage at its periphery the tie plates and rotate them counterclockwise on to a conveyor 94 along which they are conveyed to a second magnetic wheel 96 which transfers the tie plates clockwise to a conveyor 98 which conveys the tie plates ultimately to a trailing gondola car (not shown) or to a tie plate dropping mechanism which will be described below in detail. It should be understood that the above arrangement is duplicated for left and right rails so that there is a pair of such wheels aligned over each rail or, more accurately, each rail location as the old rails 20 have been lifted and moved off the tie plates at the position of the tie plate pick-up device.

Each wheel 92 or 96 is essentially non-magnetizable aluminum except for the periphery which is steel. As best seen in FIG. *2a* the periphery has two equally radially extending continuous steel flanges 100 magnetically interconnected by a steel band 102 which extends around the entire periphery in the recess between the two flanges 100. Small permanent magnets (not shown) are mounted around the periphery of the wheel immediately under and magnetically engaged with the steel band 102.

Wheels 92 and 96 are rotatably mounted on transverse axes, wheel 92 being located behind, in the direction of travel of the rail changing machine, the other wheel and being disposed lower than wheel 96. A pair of such wheels is located, respectively, over each rail. Both pairs of wheels are carried on a frame 104 which is mounted for lateral movement on the main frame 10 of the rail changing machine. To this end, the main frame 10 carries an I-beam 106 welded to the underside of main frame 10 and extending transversely thereof, and main frame 10 carries another I-beam 108 welded to a support member 110, in turn welded to the underside of the main frame. I-beam 106 is disposed with its web vertical and I-beam 108 with its web horizontal.

Frame 104 includes two spaced longitudinally extending beams 112, one of which can be seen in the drawing, interconnected at their ends by transverse members 114 to form a rectangular subframe 105. Upstanding from the forward ends of beams 112 are vertical beams 116 the tops of which are interconnected by a flat transverse member 118. Two rows of rollers 120 are rotatably mounted in journal members 122 secured to the top of member 118 by bolts or other fastening means at both end portions of member 118. The rollers 120 are received on both sides of the web of I-beam 106 and run on the flanges of the I-beam.

Near the trailing end of sub-frame 105 are two spaced depending members 124 interconnected by transverse member 126 carrying along the trailing side thereof a row of rollers 128 which run along the upper surface of the web of I-beam 108. A hydraulic cylinder 129 connected, for example, between members 110 and 124 is operable to move frame 104 laterally, the two sets of rollers running along the respective I-beams.

The front wheel 96 of each pair is journalled between a respective one of the longitudinal beams 112 and a similar parallel beam (not shown) of the frame 104, the axis of rotation 130 being approximately midway along the beams 112.

Frame 104 incorporates also two separate L-shaped sub-frames 132, one at each rail location, which carry, respectively, the second wheels 92 of the two pairs. Each sub-frame 132 comprises two laterally spaced approximately vertical beams 134 each pivotably connected near its upper end to a respective one of longitudinal beams 112 by means of a pivot pin 136 protruding laterally outwardly from beam 112 at the rotation axis 130 of wheel 96. The two laterally spaced approximately horizontal members 138 form the other arm of the L-shaped sub-frame, members 138 being secured at their one end by welding to the generally vertical members 134. Horizontal members 138 are secured to each other at the forward end by a transverse beam 137. A pneumatic cylinder 140 is connected between each sub-frame 132 and the corresponding sub-frame 105 near the trailing end of the latter for raising and lowering sub-frame 132 by pivoting it about pin 136.

A centre-line follower 142 is supported intermediate the pair of wheels 92 and 96 on the right hand side of the machine and the pair on the left hand side by means of a sub-frame 144 which is mounted forward of wheels 96 to the forward transverse member 114 which joins longitudinal beams 112. Sub-frame 144 is equidistant from beams 112 and the centre-line follower 142 is pivotally connected to the bottom portion 146 of sub-frame 144. Specifically, two links 148 of the centre line follower are mounted at their upper ends on pivot pins 150, the lower ends of links 148 being pivotally connected to the body 152 of centre-line follower 142 by means of pivot pins 154.

The body 152 of the centre line follower is adapted to run along the track in engagement with the upper surfaces of the ties as shown and move to right or left as it engages a line of nails 156 which have previously been driven into the ties to mark the centre line of the track.

It should be understood that the line of nails 156 marking the centre line of the track has been provided previously by passing a short rail car along the track, the car having a manually operable drive head located at the gauge centre, the operator driving a nail into each tie, in the case of a very sharp curve, or more usually into every third or fourth tie. This nail inserting device does not form part of the present invention and, as its general structure and operation should be clear from the above description, no detailed description thereof is deemed necessary.

The detector mechanism of the centre line follower of the present invention comprises, as best seen in FIG. 4, two parallelogram linkage mechanisms 214 and 214', one being the mirror image of the other. Each linkage mechanism comprises two parallel arms 216 (216') and 218 (218') and a slider 220 (220') pivotally connected to respective one ends of the arms 216 (216') and 218 (218'). As shown clearly in FIG. 3 the arms are actually disposed horizontally above the associated slider which is also in a horizontal plane and pivot pins 222 (222') serve as the pivotal connection between each arm and the associated slider.

The other ends of the arms 216 (216') and 218 (218') are pivotally connected to the top 224 of a housing 226 which is provided to protect the two linkage mechanism and which will be described in greater detail below. For this purpose a pin 228 (228') is carried on other end of each arm 216 (216') and 218 (218'), the pin extending vertically through the top 224 of the housing where it is journalled and held vertically. The free end of one pin 228 (228') of each linkage is aligned with and keyed to a rotatable actuator 232 (232') of a limit switch 234 (234') mounted on the housing top 224. It should be clear that each linkage 214 (214') is freely movable with the arms 216 and 218 (216' and 218') moving in one horizontal plane and the slider 220 (220') in an adjacent horizontal plane. The slider is always aligned in the same direction.

A tension spring 236 (236') can be connected between the arm 218 (218') near its junction with the slider 220 (220') and the vertical side 238 (238') of the housing 226 at a point between the arm 216 and 218 (216' and 218'). The purpose of the spring 236 (236') is to bias the linkage mechanism 214 (214') to a predetermined position. The actual predetermined position shown is one in which the arms 216 and 218 (216' and 218') extend at right angles to the slider 220 (220') but that need not necessarily be the case. Furthermore, the springs may be omitted, the inherent bias of the limit switch actuators serving to bias the linkage to the predetermined position.

The slider 220 (220') is formed as an elongate member having a curved front portion 240 (240'). When the linkages are both biased to the predetermined positions a predetermined spacing "d" is provided between sliders 220 and 220' which are disposed in mutual parallel relationship generally parallel to the track axis. The curved fronts 240 and 240' form a divergent mouth 242. The distance d may, typically by $\frac{1}{4}$". The limit switches 234 and 234' are open when their respective linkages are in the predetermined position.

Both linkages 214 and 214' are protected by the body or housing 226, the top 224 of which covers the linkages and the two spaced sides 238 of and 238' which protect the sides of the linkages. The housing is open at its bottom and at its forward and rear ends and the height of the sides is chosen so that the sliders 220 are disposed approximately 1" above the lower ends 244 and 244' of the sides 238 and 238'. Each side 238 (238') has therein a smoothly curved forward portion 246.

With reference to FIG. 4, the outputs of limit switches 234 and 234' are used to control solenoid valves 262 and 262' which, respectively control the entry of fluid into opposite sides of double acting cylinder 129.

The device of the present invention operates as follows. With the centre line detection mechanism in engagement with the track the rail changing machine is moved slowly along the track. If the centre line detector is correctly aligned with the track centre line, the nails 156 will pass through the space "d" without engaging the slider 220 or 220'. Because the space "d" is midway between each track operating means and the total distance between the two track operating means is equal to the gauge, it follows the track operating means are both correctly aligned relative to the respective rails. However, if the centre line detector is misaligned, a nail 156 will engage one of the sliders 220 or 220'. If the centre line detector is too far to the right, for example, the left hand slider 220 will be engaged by the nail and the linkage 214 will be pivoted clockwise causing the associated limit switch 234 to be turned on via arm 218. This causes solenoid valve 262 to deliver fluid to the right hand side of cylinder 219 causing the frame 104 to be moved to the left along guide rods 212 for as long as the solenoid valve remains open, i.e. as long as the slider 220 is engaged by a nail. When the gap "d" is once more aligned with the line of nails, lateral movement of the frame 104 ceases at which point the track operating means, i.e. the magnetic wheels, will be correctly aligned with their respective rails.

The length of the body 152 is preferably chosen so that it is longer than the spacing between adjacent ties. This permits the housing to bridge the gap between adjacent ties which causes smoother operation and less wear and tear on the housing. The smoothly curved portion 246 on the sides 238 of the housing permits smooth engagement with the trailing edge of each tie.

The 1" height chosen for the vertical location of the sliders 220 and 220' relates to a nail height of 2" and this permits the nail head to pass over the top of the linkage mechanisms 214 and 214', the nail shank being the part of the nail intended to engage the sliders 220 and 220'. For smaller nail heights the height of the sliders 220 and 220' may have to be reduced correspondingly.

It should be appreciated that the particular parallelogram configuration of the linkages 214 and 214' are a preferred form and other configurations are equally viable providing the slider 220 (220') is retained aligned in the same general direction at different angular positions of the linkage.

Moreover, although the centre line follower has been described in relation to a tie plate lifting device in a rail changing machine, it should be apparent that it is applicable to controlling the movement of other devices, such as the adzers of the rail changing machine, or to any track operating machine where it is required that devices carried by the machine be aligned laterally with respect to the track centre line. Furthermore, although it is more efficient to provide two track operating means, one at each rail location, controlled by the same centre line follower, it should be appreciated that the scope of the invention extends to the control of a single track operating means.

What I claim is:

1. A method of laterally positioning a railway track operating device, which is mounted for lateral movement on a rail-mounted machine, with respect to the centre line of the track comprising marking the centre line of the track by means of nails driven into at least some of the ties, and passing a centre line follower device mounted on the track operating device along the track in engagement with the top surface of the ties and so as to bridge the gap between adjacent ties, the centre line follower being adapted to engage the nails and derive an electrical signal representative of the lateral direction in which said follower deviates from the centre line, and using this electrical signal to drive the centre line follower and track operating device in a lateral direction so as to cancel the electrical signal.

2. A rail mounted machine provided with a main frame and a secondary frame mounted for lateral movement on the main frame, the secondary frame carrying two similar track operating means for carrying out a specific operation at two respective lateral locations relative to the centre line of the track, means for moving the secondary frame laterally relative to the main frame to position the track operating means at the respective lateral locations, and a centre line follower connected to said moving means and having a housing having an open bottom, two spaced sliders contained in the housing and extending generally longitudinally relative to the main frame for sensing individual members of a row of discrete, spaced members on ties along the predetermined centre line of the track which is independent of the rails of the track on which said machine is mounted, said housing having sides extending downwardly for engaging the ties, the lower edges of said sliders being slightly above the lower edges of said sides, and said sides being longer than the spacing between ties, means mounting each slider on the housing for relative movement in a direction towards and away from the other slider, means biasing the sliders to a relatively proximate position in which the sliders define a longitudinal channel of predetermined width and location, and means deriving electrical signals which indicate which slider has been moved laterally away from the proximate position.

3. A machine according to claim 2, wherein the means mounting each slider for relative movement in a direction towards and away from the other slider comprises two parallel spaced links pivotally connected at their one ends to longitudinally spaced locations on the slider and pivotally connected at their other ends on two pivotable pins on the housing.

4. A machine according to claim 3, wherein the sliders are curved away from each other at one end to define a mouth for the channel.

5. A machine according to claim 3, wherein the means deriving an electrical signal comprises two limit switches respectively actuated in response to movement by a respective slider when that slider moves away from the other slider, the limit switches respectively operating in opposite lateral direction the means for moving the secondary frame laterally relative to the main frame.

6. A machine according to claim 5, wherein the limit switches have rotatable actuators each rotatably connected to a respective one of the pivotable pins connecting the parallel spaced links to the housing.

7. A machine according to claim 6, wherein the pivotable pins are suspended from a roof portion of the housing, two of the pivotable pins projecting through the roof portion and engaging respective actuators of the limit switches, said limit switches being mounted on top of the housing.

8. A machine according to claim 7, wherein the means for moving the secondary frame is a double acting fluid cylinder connected to a source of fluid through solenoid valve means operated by the limit switches.

9. A machine according to claim 2, in which the means deriving an electrical signal comprises two limit switches respectively actuated in response to movement by a respective slider when that slider moves away from the other slider, the limit switches respectively operating in opposite lateral directions the means for moving the secondary frame laterally relative to the main frame.

10. A machine according to claim 9, in which the means for moving the secondary frame is a double acting fluid cylinder connected to a source of fluid through solenoid valve means operated by the limit switches.

11. A machine according to claim 2, wherein the means biasing the sliders to a relatively proximate position comprises springs mounted between the sliders and the housing.

12. A machine according to claim 2, wherein the means biasing the sliders to a relative proximate position comprises spring means in the limit switches.

* * * * *